United States Patent [19]

Ichiga et al.

[11] Patent Number: 4,866,341

[45] Date of Patent: Sep. 12, 1989

[54] DISCHARGE LAMP WITH BASE FOR SEALING THE LAMP

[75] Inventors: Hiroyasu Ichiga, Hirakata; Kiyoshi Tsutsumi, Amagasaki; Nobuto Tsujikawa, Osaka, all of Japan

[73] Assignee: West Electric Company, Ltd., Osaka, Japan

[21] Appl. No.: 70,446

[22] Filed: Jul. 7, 1987

[30] Foreign Application Priority Data

Jul. 7, 1986 [JP] Japan ..... 61-159090

[51] Int. Cl.[4] ..... H01J 17/18; H01J 61/36

[52] U.S. Cl. ..... 313/623; 313/332; 313/318; 313/609; 313/610; 313/625

[58] Field of Search ..... 313/609, 610, 623, 625, 313/634, 318, 332, 493, 573, 624

[56] References Cited

U.S. PATENT DOCUMENTS

| | | | |
|---|---|---|---|
| 3,651,366 | 3/1972 | Giannini | 315/243 |
| 4,147,951 | 4/1979 | Mueller | 313/610 |
| 4,191,907 | 3/1980 | Rogoff | 313/610 |
| 4,196,374 | 4/1980 | Witting | 313/610 X |
| 4,282,395 | 8/1981 | Hagemann | 313/331 X |
| 4,475,058 | 10/1984 | Takeda et al. | 313/493 |
| 4,490,642 | 12/1984 | Dobrusskin et al. | 313/634 X |

FOREIGN PATENT DOCUMENTS

| | | | |
|---|---|---|---|
| 104516 | 8/1964 | Norway | 313/635 |

*Primary Examiner*—Donald J. Yusko
*Assistant Examiner*—Michael Horabik
*Attorney, Agent, or Firm*—Cushman, Darby & Cushman

[57] ABSTRACT

A discharge lamp comprises a cylindrical glass bulb with an open bottom and a closed top of dome-shape or flat-shape, a base for holding an anode and a cathode with at least one separation plate for dividing an inner space of the bulb into plural spaces forming a folded discharge path, and the base is directly and airtightly bonded to the bottom opening of the bulb by heat softening of the bulb, and the anode and cathode are also airtightly fixed on the base by selectively melting down of a first adhesive and a second adhesive which each have different melting points.

8 Claims, 10 Drawing Sheets

DISCHARGE LAMP WITH BASE FOR SEALING THE LAMP

FIELD OF THE INVENTION AND RELATED ART STATEMENT

1. FIELD OF THE INVENTION

The present invention relates to a discharge lamp to be used as a light source, and especially a discharge lamp of an electronic discharge apparatus to be used for photography.

2. DESCRIPTION OF THE RELATED ART

An electric apparatus such as an electronic discharge apparatus in which a discharge lamp is used as a light source, is recently desired to be compact for easy carrying, and to be bright.

While traditional discharge lamps having a straight shaped, a convolution type and the like discharge path, are well-known, the miniaturization of the same limits the brightness, the working method, the accuracy and the like.

On the other hand, when the miniaturization of the light source is considered, it is suitable to be a point light source. As a means for miniaturizing the light source, a gas discharge lamp, for example, shown in U.S. Pat. 4,147,951, in which main electrodes are airtightly held on one end of a bulb is known. Such gas discharge lamp, as shown in FIG. 6(*a*) and FIG. 6(*b*), includes a solder glass plate (or base) 4 made of an insulating material and for holding electrodes 2 and 3 is airtightly bonded on a bottom part 1*a* of a bulb (tube wall) 1, a bottom part 5*a* of a separation plate 5 of an insulating material is also airtightly fixed between the electrodes 2 and 3 on the solder glass plate 4, and both side edges 5*b* of the separation plate 5 are airtightly bonded on the inner surface of the bulb 1, except its bottom part 6, by using solder glass 7 as an adhesive. A connection space 1*d* is defined by the top part 5*c* of the separation plate 5 and the top part 1*b* of the bulb 1, and a top tip (melted tube end) 1*c* for exhausting air and enclosing an inert gas is formed on the top part 1*b* of the bulb 1.

As mentioned above, in the conventional gas discharge lamp, by separating the inner part of the bulb 1 by the separation plate 5 thereby to form a folded discharge space, and the main electrodes 2 and 3 are disposed on respective ends of the folded discharge space near the bottom 1*a*, so that the height of the lamp is decreased for miniaturizing the size of the gas discharge lamp. The gas discharge lamp has, however, the bottom part 6 where the bottom part of the separation plate 5 is not airtightly bonded to the base 4 in case of using for an electronic discharge apparatus, and the electronic discharge occurs in the bottom part 6 through a narrow gap between the bottom edge of the separation plate 5 and the base 4. Accordingly, though the separation plate 5 is provided the effect thereof to double the discharge path length is not achieved.

In the above-mentioned conventional gas discharge lamp, a glass having a low melting point is used for the solder glass 7, and the work of skillfully positioning of suitable amount of solder glass 7 between both side edge parts of the separation plate 5 and the inner surface of the bulb 1 and melting the solder glass 7 for airtightly bonding in a manner to airtightly bond the bottom end edge of the solder glass plate 7 to the base 4 is difficult. In addition, even when the above-mentioned bulb could be made, the solder glass is on a discharge path, and impurity gas is blown up from the solder glass, and therefore the above-mentioned bulb is not preferable for the discharge lamp.

Furthermore, in case of dividing the bulb in four parts rather than the two parts, it is necessary to airtightly bond the upper part of the separation plate 5 with the inner surface of the bulb 1. On the other hand, such discharge lamp has the melted top tip 1*c* over the top part 1*b* of the bulb 1, and therefore the bonding work for airtightly bonding the separation plate 5 with the inner surface of the bulb 1 at the top part may be very difficult and such bulb is not suitable for mass-production.

OBJECT AND SUMMARY OF THE INVENTION

The object of the present invention is to provide an improved discharge lamp having brief construction and being suitable for mass-production.

A discharge lamp in accordance with the present invention comprises, a cylindrical glass bulb with an open bottom and a closed top having a rare gas therein, a base which is fitted to the open bottom, having separation means for dividing an inner space of the cylindrical glass bulb into plural spaces forming a folded discharge path, and having a stem with two through-holes thereon and for sealing the open bottom of the cylindrical glass bulb, the separation means and the stem being formed integral in one body, and a pair of electrodes to serve as an anode and a cathode which are respectively inserted into the two through-holes disposed near both end parts of the discharge paths and airtightly bonded on the stem of the base.

BRIEF DESCRIPTION OF THE DRAWINGS

FIG. 1(*b*) is a partial cross-sectional front view showing the discharge lamp shown in FIG. 1(*a*).

FIG. 5(*b*) is a perspective view showing the base 11 shown in FIG. 5(*a*).

DESCRIPTION OF THE PREFERRED EMBODIMENTS

Figure 1:
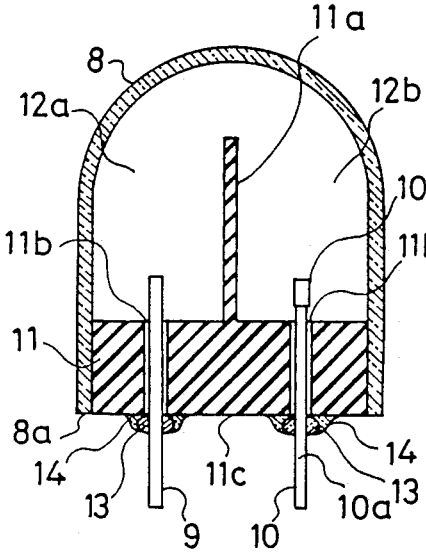
FIG. 1(*a*) is a cross-sectional side view showing a preferred embodiment of a discharge lamp in accordance with the present invention.
Figure 1:
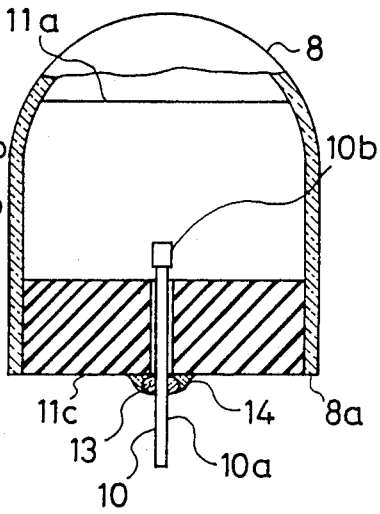

A preferred embodiment of a discharge lamp in accordance with the present invention is described as follows with reference to FIGS. 1(*a*) and 1(*b*). As shown in FIGS. 1(*a*) and 1(*b*), the discharge lamp in accordance with the present invention comprises a cylindrical glass bulb 8 one of which tube end (for example top) is dome shaped and another tube end (for example bottom) 8a is opened, and a pair of electrodes namely an anode 9 and a cathode 10 disposed on the open bottom 8a. Hereupon, the cathode 10 is composed of a cathode rod 10a and a cathode pellet 10b, which is welded on the cathode rod 10a.

The discharge lamp further comprises a base 11 for example made of ceramics having a thermal expansion coefficient which is equal or nearly equal to that of the bulb 8, the anode 9 and the cathode 10, and also having a higher softening temperature than that of the bulb 8. It is suitable to use a ceramic having a thermal expansion coefficient equal or nearly equal to that of a hard glass and being colored white which hardly absorbs the discharged light because the hard glass is generally used for a glass material of the bulb 8 and the base exists along a discharge path. As a result, in this embodiment, a white mullite which has the thermal expansion coefficient of $44\times10^{-7}/°$ C. which is near to that of $38\times10^{-7}/°$ C. of the hard glass is used for material of the base 11.

The base 11 comprises a separation plate 11a for separating the inner space of the bulb 8 in to plural parts, for example, two spaces 12a and 12b and a stem 11c having two through-holes respectively disposed on the separated two spaces 12a and 12b and through which a pair of electrodes 9 and 10 penetrate to the spaces 12a and 12b. the separation plate 11a and the stem 11c are formed integral in one body and the stem 11c is fit into the open bottom 8a of the bulb 8.

The side edge of the stem 11c of the base 11 and the inner surface of the open bottom 8a of the bulb 8 are airtightly bonded by using a deformation by softening of heated glass and the like, and the separated two spaces 12a and 12b are respectively interlinked with each other over the separation plate 11c and they form a U-letter shaped discharge path.

The electrodes 9 and 10 are fixed onto the stem 11c by a first adhesive 13 which has good bonding ability to the electrodes 9 and 10, by positioning them in the through-holes 11b. Furthermore, the electrodes 9 and 10 are airtightly bonded on the stem 11b over the first adhesive 13 by a second adhesive 14 which has a good bonding ability against the stem 11c of the base 11 and the first adhesive 13 and has a lower melting point than that of the first adhesive 13.

As above-mentioned first and second adhesives 13 and 14, such ones respectively having equal or nearly equal thermal expansion coefficients and also equal or nearly equal to the pair of electrodes 9 and 10 and the base 11 are selected; and especially, the second adhesive 14 is limited by a condition of having lower melting point than the material of the bulb 8. In the inner space of the bulb 8, a fixed rare gas, for example, xenon gas is filled.

The above-mentioned discharge lamp in accordance with the present invention is made by the following manufacturing processes described with reference to FIGS. 2(*a*), 2(*b*), 2(*c*), 2(*d*), 2(*e*), 2(*f*), 2(*g*), 2(*h*), 2(*i*) and 2(*j*), which schematically show manufacturing processes for making the discharge lamp.

Figure 2:
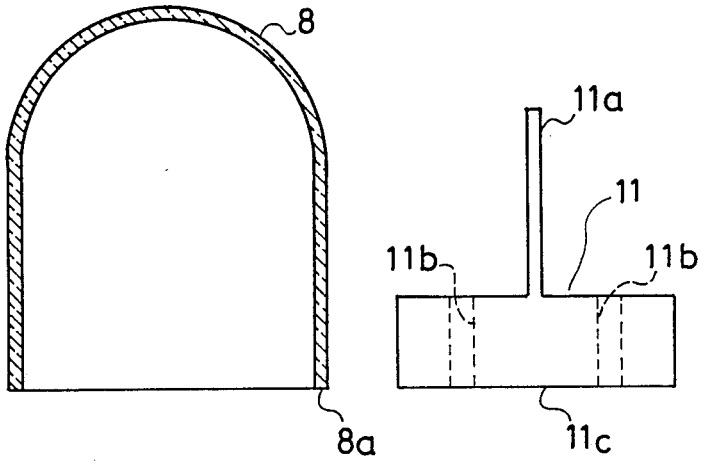
FIG. 2(*a*), FIG. 2(*b*), FIG. 2(*c*), FIG. 2(*d*), FIG. 2(*e*), FIG. 2(*f*), FIG. 2(*g*), FIG. 2(*h*) and FIG. 2(*j*) are respectively showing making processes of the discharge lamp shown in FIGS. 1(*a*) and 1(*b*).
Figure 2:
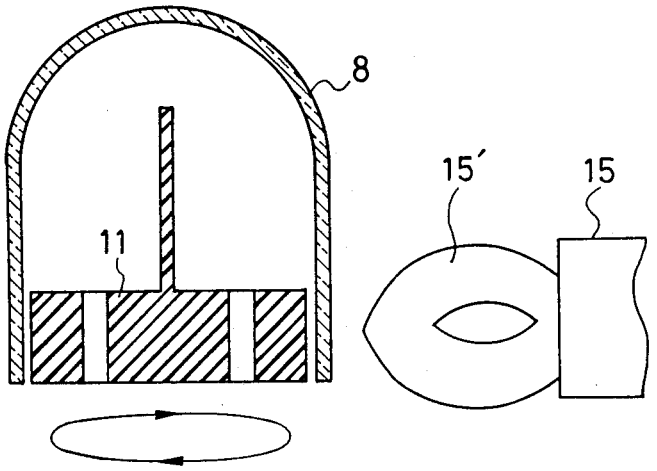
Figure 2C:
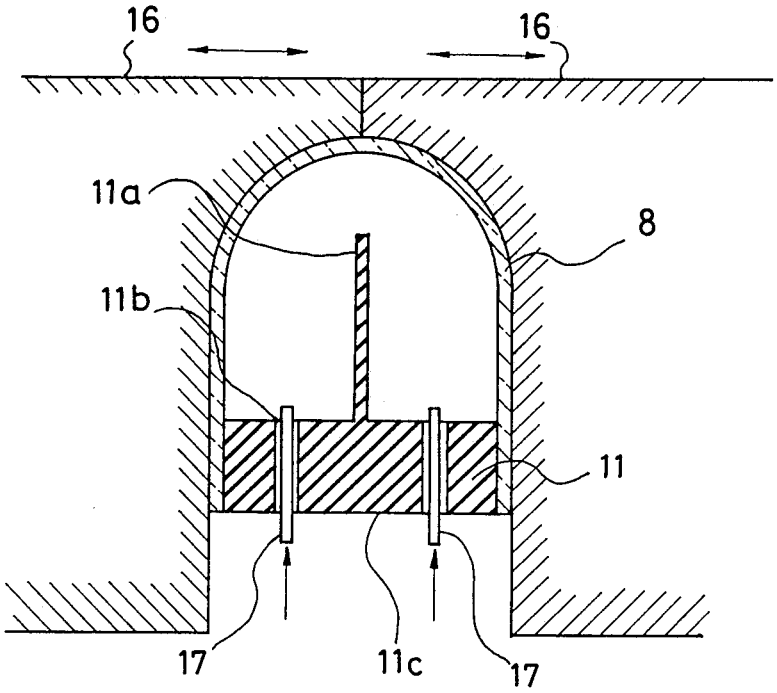
Figure 2D:
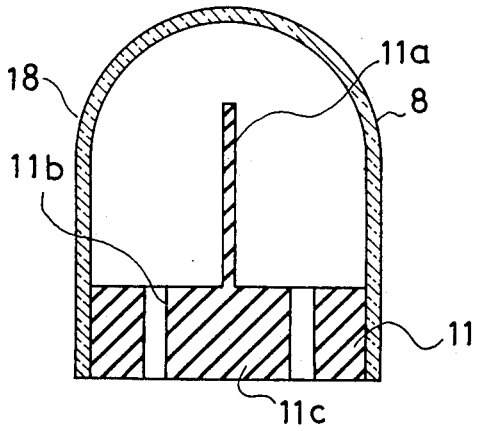
Figure 2E:
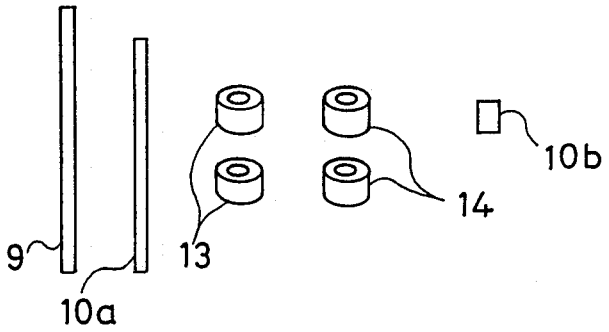
Figure 2F:
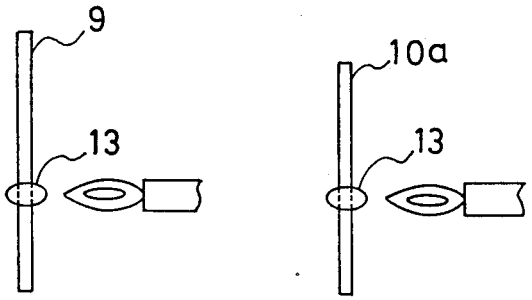
Figure 2G:
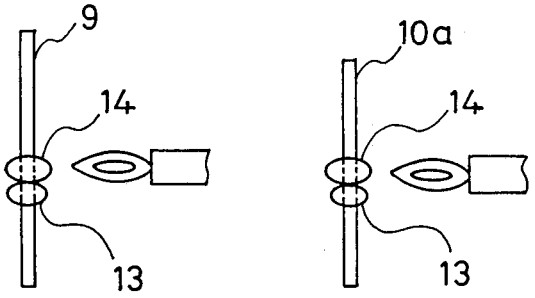
Figure 2H:
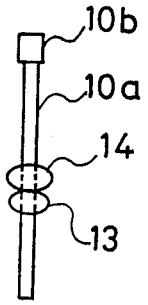
Figure 2I:
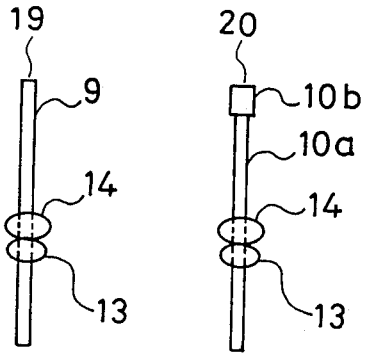
Figure 2:
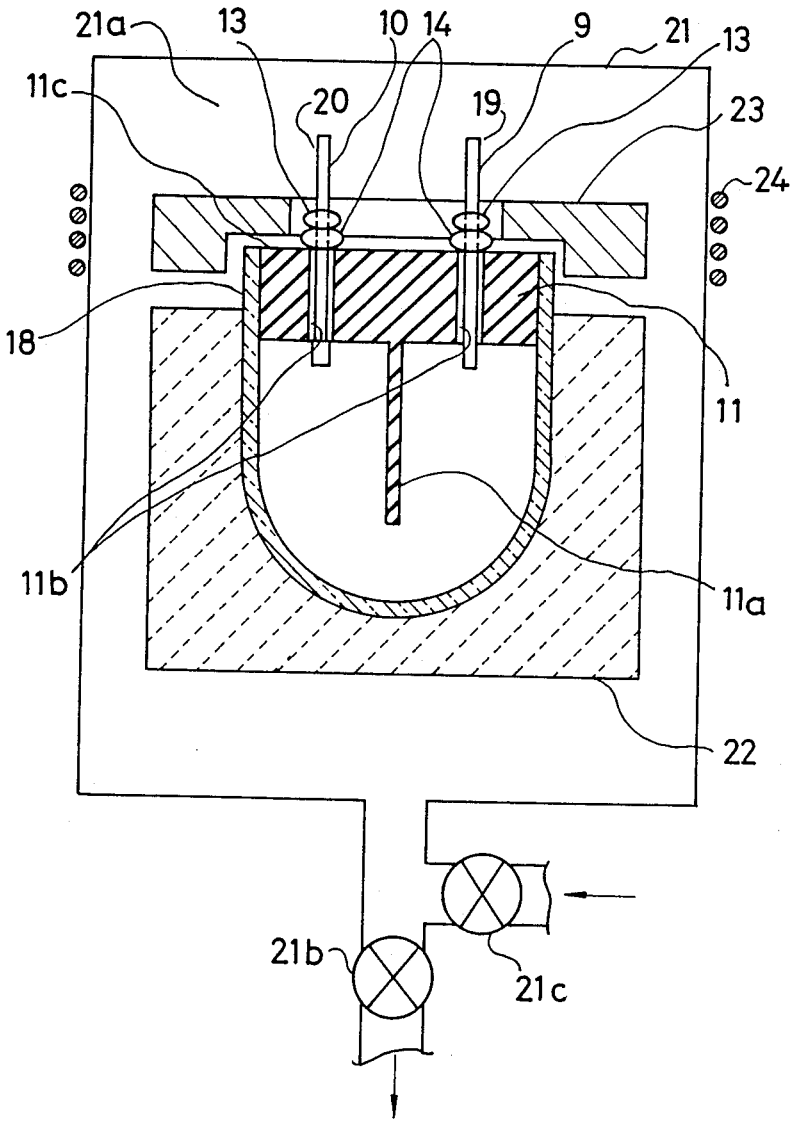

In FIG. 2(*a*), a bulb 8, having open bottom end and a base 11 are prepared, the base 11 is inserted into the inner space of the bulb 8 from the open bottom 8a, and the base 11 and the bulb 8 is heated by flame of a burner 15 with rotating the bulb 8 and the base 11 as shown in FIG. 2(*b*).

Generally, a glass is used for the bulb 8, so that the bulb 8 is softened with thickening by heating and deformed to a smaller diameter by its own weight and the pressure of the fire of the burner 15. Namely the bulb 8 shows heat contraction characteristic in the process shown in FIG. 2(*b*).

Accordingly, when the sizes of the separation plate 11a and the diameter of the stem 11c of the base 11 are made slightly smaller than the inner size of the bulb 8, they can be airtightly bonded with each other by deformation of the bulb 8 by the above-mentioned heat softening.

If the base 11 were not airtightly bonded to the bulb 8, it is difficult to use the deformated bulb 8 due to the softening as a light source. Then, in order to prevent such deformation, the bulb 8 enclosing the base 11 and being in softened state is reformed by use of an embossing machine 16 and air pressure supplied into the inner space of the bulb 8 by nozzles 17 inserted into the through-holes 11b on the base 11. As a result, a reformed discharge lamp bulb 18 which consists of the bulb 8 and the base 11 shown in FIG. 2(*d*) is completed.

FIGS. 2(*e*) to 2(*j*) schematically show the steps for making a pair of inserted elements 19 and 20 which are fixed over the above-mentioned discharge lamp bulb 18 for making a discharge lamp in accordance with the present invention.

In FIG. 2(*e*), an anode 9, a cathode rod 10a, a cathode pellet 10b, two pairs of cylindrical glass beads 13, 13 and 14, 14 respectively to become the first and the second adhesives 13 and 14 are prepared.

At first, a pair of glass beads corresponding to the first adhesive 13 are outserted and positioned on a predetermined position of the anode 9 and the cathode rod 10a, respectively, and each glass beads are heated and melted for bonding to the anode 9 or the cathode rod 10a by, for example, the burner as shown in FIG. 2(*f*).

Next, a pair of glass beads corresponding to the second adhesive 14 are also outserted and positioned on another fixed position neighboring to the above-mentioned position of the anode 9 and the cathode rod 10a, respectively, and fixed temporarily thereon by heating and melting by, for example, the burner.

Furthermore, the cathode pellet 10b is fixed at a top part of the cathode rod 10a by using a well-known welding technique, as shown in FIG. 2(*h*). Hereupon, the top part where the cathode pellet 10b is fixed is near the glass bead corresponding to the second adhesive 14 in this embodiment. By the above-mentioned steps, the inserted elements 19 and 20 respectively contain the anode 9 and the cathode 10 are completed, as shown in FIG. 2(*j*).

Finally, the above-mentioned inserted elements 19 and 20 are airtightly bonded to the discharge lamp bulb 18, and such bonding process is shown in FIG. 2(*j*).

In FIG. 2(*j*), a chamber 21 comprises an exhausting valve 21b for controlling the exhaust of air in the chamber 21 by an exhaust apparatus (not shown in the figure), a supply valve 21c for controlling the supply of rare gas from a rare gas supplier (not shown in the figure), a ceramic jig 22 for holding the discharge lamp bulb 18 and a carbon jig 23 for covering the stem part 11c of the base 11 of the discharge lamp bulb 18.

A high frequency solenoid 24 for heating the carbon jig 22 is disposed on the circumference of the chamber 21.

The airtight bonding of the discharge lamp bulb 18 and the inserted elements 19 and 20 is practiced as follows. At first, the inserted elements 19 and 20 are inserted into the through-holes 11*b* on the base 11. After that, the discharge lamp bulb 18 and the base 11 are held in the ceramic jig 22 and under the carbon jig 23 in the chamber 21 as shown in FIG. 2(*j*).

Next, opening the exhausting valve 21*b* and practicing the exhaust of the inner space of the chamber 21*a* by the exhausting apparatus, the air in the discharge lamp bulb 18 is also exhausted through the gap between the through holes 11*b* and the inserted elements 19 and 20, which are merely inserted into the through-holes 11*b* and not yet airtightly bonded to the discharge lamp bulb 18.

After finishing the exhaustion of the inner space of the chamber 21*a* and the discharge lamp bulb 18, a suitable rare gas, for example, xenon gas is filled into the chamber 21 by opening the supplying valve 21*c*, thereby filling the discharge lamp bulb 18 with the rare gas.

When the carbon jig 23 is heated by the high frequency solenoid 24, only the second adhesive 14, which has lower melting point than that of the first adhesive 13 and the material of the glass bulb 8, is melted. And the inserted elements 19 and 20 move down in the figure until the beads of adhesive 13, 13 touch the stem 11*c* by their own weight.

By stopping the heating of the carbon jig 23 due to the high frequency solenoid 24 in such state, the second adhesive 14 solidifies and airtightly connects the first adhesive 13 and the base 11 thereby making airtight sealing. As a result, the discharge tube shown in FIG. 1 is completed.

By the way, it is suitable to further comprise a pushing jig to press the inserted elements 19 and 20 down during the heating of the carbon jig 23 by the high frequency solenoid shown in FIG. 2(*j*).

The step of temporary fixing of the second adhesive 14 shown in FIG. 2(*g*) can be included in the step shown in FIG. 2(*j*). Namely, by disposing the second adhesive 14 having a shape shown in FIG. 2(*e*) against the anode 9, the cathode rod 10*a* and the first adhesive 13 as shown in FIG. 2(*j*), and by heating the carbon jig 23 by the high frequency solenoid 24, the discharge lamp shown in FIG. 1 is obtainable. In the above-mentioned case, exhaustion of air from and filling the rare gas in the bulb 8 can be made more efficiently, by disposing protrusions on such a surface of beads to become the second adhesive 14 that contacting with the base 11.

Figure 3:
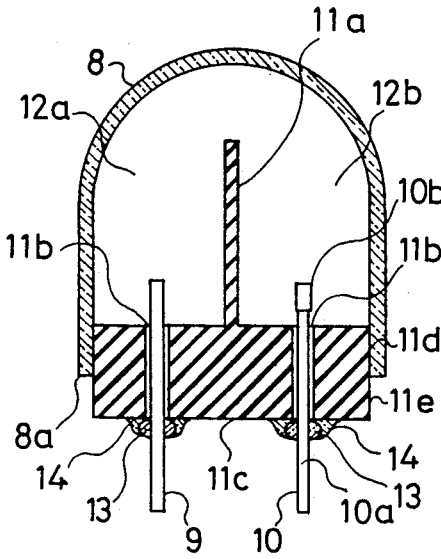
FIG. 3(*a*) and FIG. 3(*b*) are a cross-sectional side view and a partial cross-sectional front view showing another preferred embodiment of the discharge lamp in accordance with the present invention.
Figure 3:
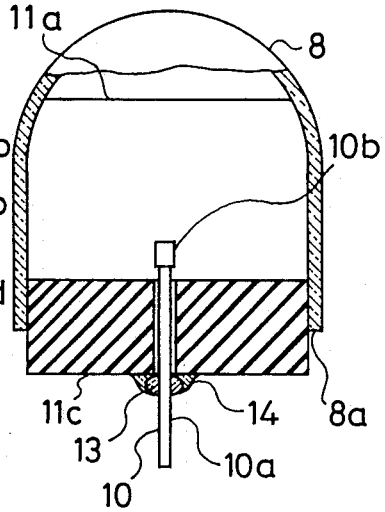

FIGS. 3(*a*) and 3(*b*) are respectively cross-sectional side view and partially cross-sectional front view showing another preferred embodiment of the discharge lamp in accordance with the present invention.

In this embodiment, the base 11 is airtightly bonded to the inner surface of the bulb 8 at the side part 11*d* of the stem 11, as shown in FIGS. 3(*a*) and (*b*). And other constitution is substantially the same as the discharge lamp shown in FIGS. 1(*a*) and (*b*).

The discharge lamp shown in FIGS. 3(*a*) and 3(*b*) has a lower outside part 11*e* of the stem 11*b* of the base 11, which is not airtightly bonded to the bulb 8. Therefore, it is possible to make a convex part or concave groove on the above-mentioned part 11*e*, and in case of using a shade or a reflector (not shown in the figure) with the discharge lamp, it is easy to fix the reflector by using the convex part or concave ring as fixing means.

Figure 4:
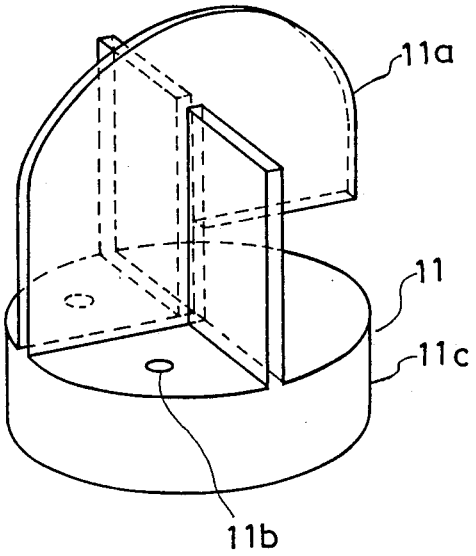
FIG. 4 is a perspective view showing a still other embodiment of a base 11 of the discharge lamp in accordance with the present invention.

FIG. 4 is a perspective view showing still another embodiment of the base 11 of the discarge lamp in accordance with the present invention, wherein the shape of the separation plate 11*a* is different from the above-mentioned embodiments.

Namely, in the embodiment shown in FIGS. 1(*a*) and (*b*), the inner space of the bulb 8 is divided into two divided spaces 12*a* and 12*b* by the separation plate 11*a*, but the embodiment shown in FIG. 4 is designed to have four divided spaces, in other words, to have two interlinked U-letter-shaped or folded W-letter shaped electronic discharge path. thus, it is possible to form a longer discharge path, and in other words, discharge path having the same length can be executed in a lower height.

Figure 5:
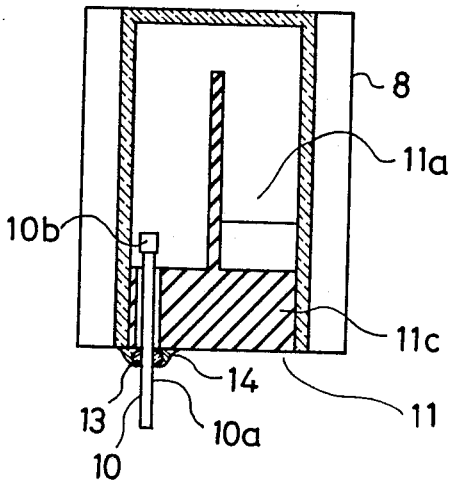
FIG. 5(*a*) is a cross-sectional side view showing a still other preferred embodiment of the discharge lamp in accordance with the present invention.
Figure 5:
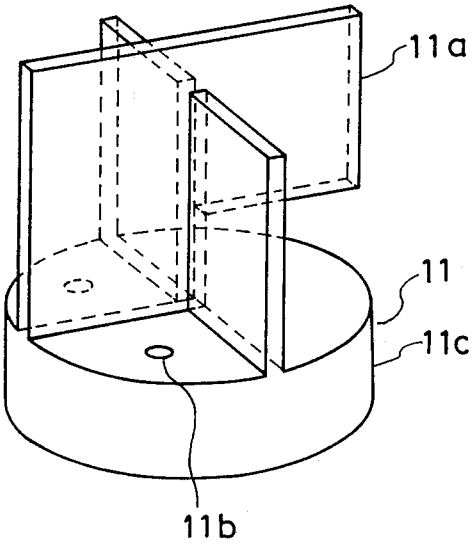
Figure 6:
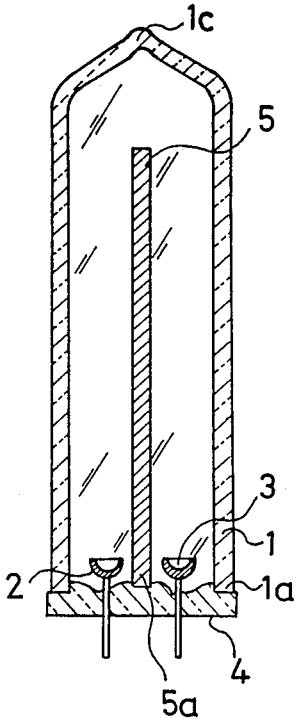
(Prior Art) FIG. 6 (a)
FIGS. 6(*a*) and (*b*) are the cross-sectional side view and the front view showing the conventional discharge lamp for example shown in U.S. Pat. 4,147,951, respectively.
Figure 6:
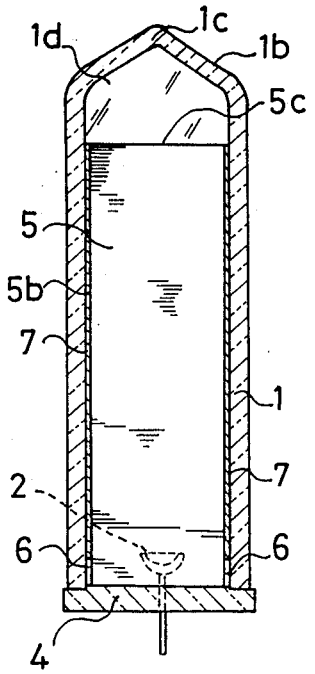
(Prior Art) FIG. 6 (b)

FIGS. 5(*a*) and 5(*b*) show still other embodiment of the discharge lamp in accordance with the present invention, in which the inner space of the bulb 8 is divided into four spaces by the separation plates 11*a*. At the top part, the bulb 8 of this embodiment has, however, a flat type closed top instead of the dome shaped closed top. Accordingly, the total height of the discharge lamp having the same length of the discharge path can be lowered than that of the embodiment shown in FIG. 4.

Furthermore, instead of the separation plate 11*a* on the base 11 various other space dividing means, for example, a mean for forming a spiral type discharge path.

Since the discharge lamp in accordance with the present invention has the above-mentioned constitution, the inner surface of the bulb 8 and the base 11 can be airtightly bonded at the separation plate 11*a* of the base 11 and the stem 11*b* at the same time, and also a pair of electrodes 9 and 10 seal the bulb 8 airtightly with being precisely positioned against the bulb 8 by the bonding on the base 11 due to the first and the second adhesives 13 and 14 without using any top tip for exhausting air and filling the rare gas into the inner space of the bulb 8.

Namely, the softening of the glass of the bulb 8 can be used for airtight bonding of the base 11 and the bulb 8 itself, and also the airtight bonding of the pair of electrodes 9 and 10 to the bulb 8 is mediately made by melting down of the second adhesive 14 having lower melting point than the first adhesive 13 for airtightly bonding the beads of the first adhesive 13 fixed on the electrodes 9 and 10 to the base 11 without deforming the bead shape. Furthermore, the exhausting of the air from or filling the rare gas into the bulb 8 can be practiced by using gaps between the electrodes 9 and 10 and the through-holes 11*b* before the melting down step or the full-melting down of the second adhesive 14.

In other words, it is possible to adopt a simple manufacturing process to mass-production, which has steps of (a) fixing the bead-shaped first adhesive 13 on the through-holes 11*b* of an assembly made of airtight bonding of the bulb 8 and the base 11, (b) inserting the pair of electrodes 9 and 10 on which the bead-shaped second adhesives 14 are temporarily fixed, to the through-holes 11*b*, (c) exhausting air from and filling rare gas into the inner space of the assembly by using the gaps of the through-holes 11*b* and the electrodes 9 and 10 without using any melting top tip, and (d) melting down of the second adhesive 14 for airtightly bonding the electrodes 9 and 10 on the bulb 8 by intermediating the base 11.

Furthermore, the bulb 8 of the present invention does not need any tip for exhusting air or filling rare gas, so that the top of the bulb 8 is preliminarily shaped in a simple shape, for example, dome-shaped or flat shaped. And also by adopting the base 11 shown in FIGS. 3(*a*)

and 3(*b*), FIG. 4 or FIG. 5(*b*), the inner space of the bulb 8 can easily be divided into optional plural spaces.

Furthermore, the airtight bonding process of the electrtodes 9 and 10 or the base 11 is executed by melting down of the second adhesive 14, and the second adhesive 14 can be melted in lower temperature than the first adhesive 13 and the bulb 8. Accordingly the bulb 8 is not deformed in such airtight bonding process.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A discharge lamp comprising:

a cylindrical glass bulb having an open bottom and a closed top and having a rare gas therein, a base made of a material having a thermal expansion coefficient substantially equal to that of said cylindrical glass bulb and having a softening temperature higher than that of said cylindrical glass bulb, and fitted to said open bottom of said cylindrical glass bulb, said base having separation means for dividing an inner space of said cylindrical glass bulb into plural spaces forming a folded discharge path, and having a stem with two through-holes thereon, a part of the circumference of said stem facing a part of an inner surface of said cylindrical glass bulb in the proximity of said open bottom of said cylindrical glass bulb for being airtightly bonded to and sealing said open bottom of said cylindrical glass bulb, said separation means and said stem being integral in one body, a pair of electrodes to serve as an anode and a cathode which are respectively to be inserted into said two through-holes disposed near both ends of said discharge paths, first adhesive having a thermal expansion coefficient substantially equal to that of said electrodes, fixed on said electrodes and having a bead shape with a diameter larger than that of said through-holes for positioning said electrodes to said through-holes on said base; and second adhesive having a thermal expansion coefficient substantially equal to that of said first adhesive and having a softening temperature lower than those of said first adhesive and said cylindrical glass bulb, and airtightly sealing at least gaps between said first adhesive and said electrodes and said first adhesive and said base by melting down below a softening temperature of said first adhesive.

2. A discharge lamp in accordance with claim 1, wherein said closed top of said cylindrical glass bulb is dome-shaped.

3. A discharge lamp in accordance with claim 1, wherein said closed top of said cylindrical glass bulb is flat.

4. A discharge lamp in accordance with claim 1, wherein the entire circumference of said stem faces an inner surface of said cylindrical glass bulb in the proximity of said open bottom of said cylindrical glass bulb.

5. A discharge lamp in accordance with claim 1, wherein said base is made of a heat resisting ceramic.

6. A discharge lamp in accordance with claim 5, wherein said ceramic is white colored.

7. A discharge lamp in accordance with claim 5, wherein said ceramic is mullite.

8. A discharge lamp in accordance with claim 1, wherein said rare gas is xenon.

* * * * *